US012789950B2

(12) United States Patent
Redburn

(10) Patent No.: US 12,789,950 B2
(45) Date of Patent: Nov. 10, 2026

(54) DOCKING APPARATUS AND METHOD

(71) Applicant: Keith Redburn, Bay City, MI (US)

(72) Inventor: Keith Redburn, Bay City, MI (US)

( * ) Notice: Subject to any disclaimer, the term of this patent is extended or adjusted under 35 U.S.C. 154(b) by 556 days.

(21) Appl. No.: 18/231,217

(22) Filed: Aug. 7, 2023

(65) Prior Publication Data

US 2024/0043097 A1 Feb. 8, 2024

Related U.S. Application Data

(60) Provisional application No. 63/395,781, filed on Aug. 5, 2022.

(51) Int. Cl.
*B63B 21/26* (2006.01)
*B63B 21/00* (2006.01)
*B63B 21/06* (2006.01)

(52) U.S. Cl.
CPC ..... *B63B 21/26* (2013.01); *B63B 21/06* (2013.01); *B63B 2021/001* (2013.01)

(58) Field of Classification Search
CPC ... B63B 21/00; B63B 2021/003; B63B 21/06; B63B 21/08; B63B 21/26
USPC ..... 114/230.1, 230.16, 230.28; 405/195.1, 405/218
See application file for complete search history.

(56) References Cited

U.S. PATENT DOCUMENTS 6,112,690 A * 9/2000 Anderson ..... E02B 3/24 114/220
6,216,625 B1 * 4/2001 Baluha ..... B63B 21/00 114/230.27
11,008,720 B2 * 5/2021 Kirby ..... E02B 3/24

* cited by examiner

*Primary Examiner* — Daniel V Venne
(74) *Attorney, Agent, or Firm* — Poznak Dyer Kanar Schefsky Thompson PLC; Robert C. Corbett

(57) ABSTRACT

A system for docking a boat on a body of water includes a pole or shaft mounted with respect to the bed of the body of water and extending above the surface of the body of water. A locking spacer is slidably connected to the pole. A member has an outer surface and an inner surface defining a cavity that is open at two ends. The member also defines a slot extending from the outer surface to the inner surface. The member is mounted to a boat. The system enables the rapid and easy mooring of the boat by maneuvering the boat so that the pole passes through the slot and into the cavity. The locking spacer is then slid along the pole until it enters the cavity, thereby locking the member with respect to the pole.

11 Claims, 10 Drawing Sheets

DOCKING APPARATUS AND METHOD

CROSS-REFERENCE TO RELATED APPLICATION

This application claims the benefit of U.S. Provisional Patent Application No. 63/395,781, filed Aug. 5, 2022, and which is hereby incorporated by reference in its entirety.

TECHNICAL FIELD

This disclosure relates generally to systems and methods for docking boats.

BACKGROUND

Docking a recreational boat, such as a pontoon boat, typically requires the installation of a dock. Docks are often substantial structures, which involve a significant cost to install.

SUMMARY

A docking system for rapidly and easily securing a boat on a body of water is provided herein. The docking system includes a docking assembly having a pole and a locking spacer. The pole is secured with respect to the bed of the body of water and extends at least partially above the body of water. The locking spacer defines a hole through which the pole extends such that the locking spacer is slidable along the pole.

A member is mounted to the boat. The member has two opposite ends, an outer surface, and an inner surface. The inner surface defines a cavity having a first opening at one of the opposite ends and a second opening at the other of the opposite ends. A slot extends from the outer surface to the inner surface and from the first opening to the second opening.

The member is configured such that the pole is insertable into cavity through the slot such that the pole extends through the first and second openings. The locking spacer is configured such that the locking spacer is insertable into the cavity through the first opening when the pole extends through the first and second openings. The locking spacer has a maximum width that is greater than the width of the slot.

Accordingly, the boat is securable to the docking assembly by moving the boat so that the pole enters the cavity through the slot, and then sliding the locking spacer into the cavity so that the locking spacer concentrically surrounds the pole and the member (except for the slot) concentrically surrounds the locking spacer. Thus, docking or mooring the boat requires only the movement of the locking spacer along the pole once the boat is in the mooring or docking position.

The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
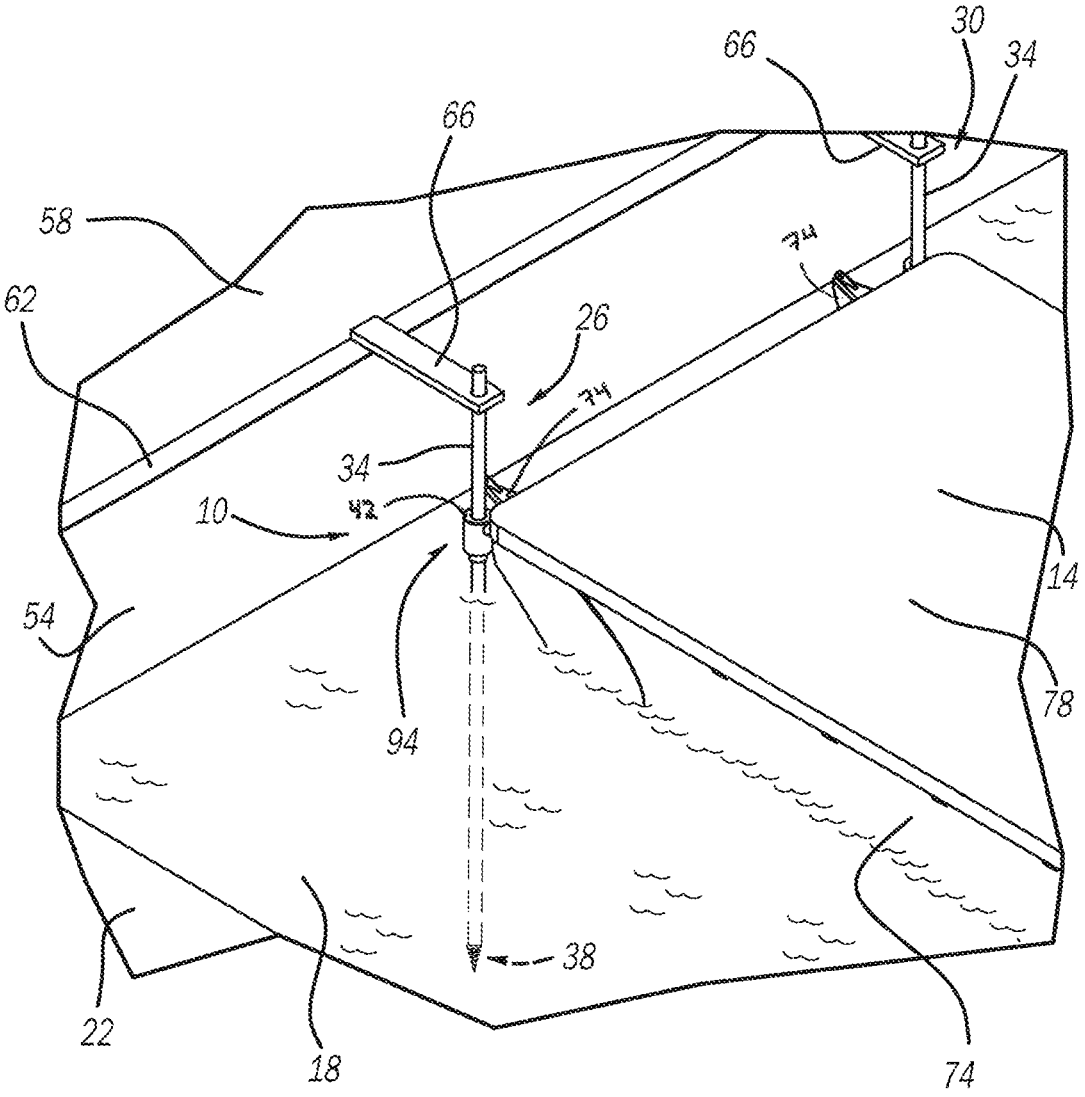
FIG. 1 is a schematic, perspective view of a docking system including a pontoon boat and docking assemblies adjacent a seawall.

Referring to the Figures, wherein like reference numbers refer to like components throughout, a system 10 for docking or mooring a boat 14 in a body of water 18 having a bed 22 is schematically depicted. The body of water 18 may, for example, be a river, lake, etc., and the bed 22 is the bottom, such as a lake bed, a river bed, etc. The system 10 includes a first docking assembly 26 and a second docking assembly 30. The first docking assembly 26 includes a first pole or shaft 34; a first auger 38 mounted at one end of the first pole 34, and a first locking spacer 42.

The first locking spacer 42 defines a first cylindrical hole 46 that extends therethrough. The first docking assembly 26 is rotated with the first auger 38 in contact with the bed 22 such that the first auger 38 is driven into the bed to support the first pole 34 in a vertical position. Thus, the first auger 38 is within the bed 22. The first pole 34 extends upward from the first auger 38 to above the surface 50 of the body of water 18. The first pole 34 extends through the first cylindrical hole 46 such that the first locking spacer 42 is slidable along the first pole 34.

In the embodiment depicted, the first docking assembly 26 is mounted adjacent to a seawall 54. The seawall 54 separates the body of water 18 from land 58. In the embodiment depicted, the seawall 54 extends vertically, and is characterized by a top surface 62. The first docking assembly 26 includes a first horizontal bracket 66 interconnecting the first pole 34 and the top surface 62 of the seawall 54 to stabilize the first pole 34 and maintain it in a vertical orientation.

The second docking assembly 30 is substantially identical to the first docking assembly 26, but spaced a distance apart from the first docking assembly 26.

Figure 5:
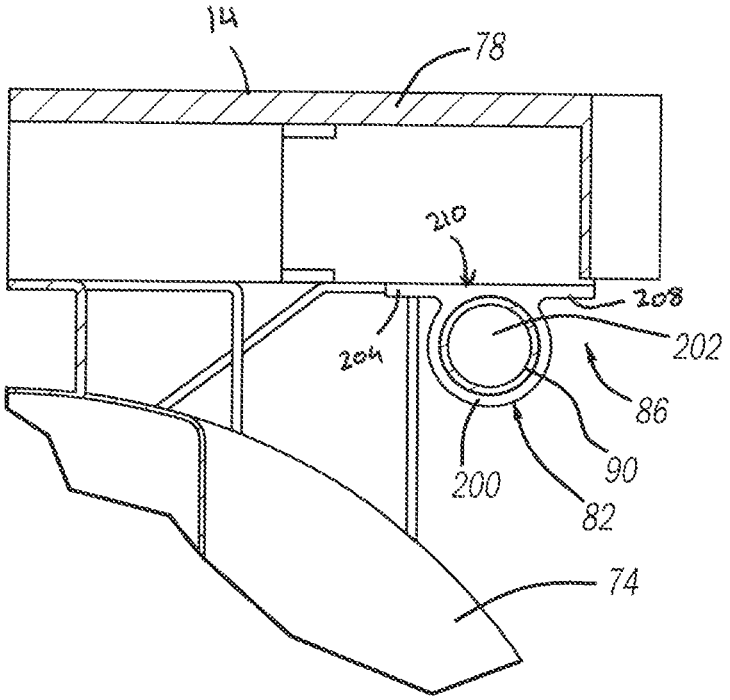
FIG. 5 is a schematic, sectional, front view of a portion of the pontoon boat with a cylindrical receiver attached thereto to support holders.
Figure 6:
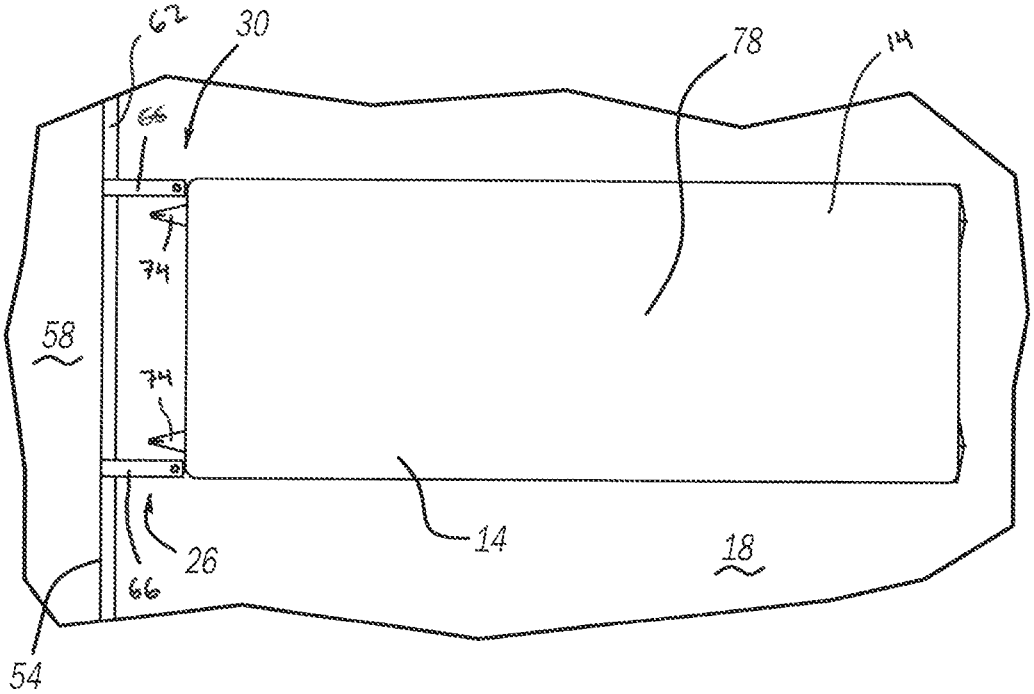
FIG. 6 is a schematic, top view of the docking system with the pontoon boat positioned so that the holders have the poles of the docking assemblies extending therethrough.
Figure 7:
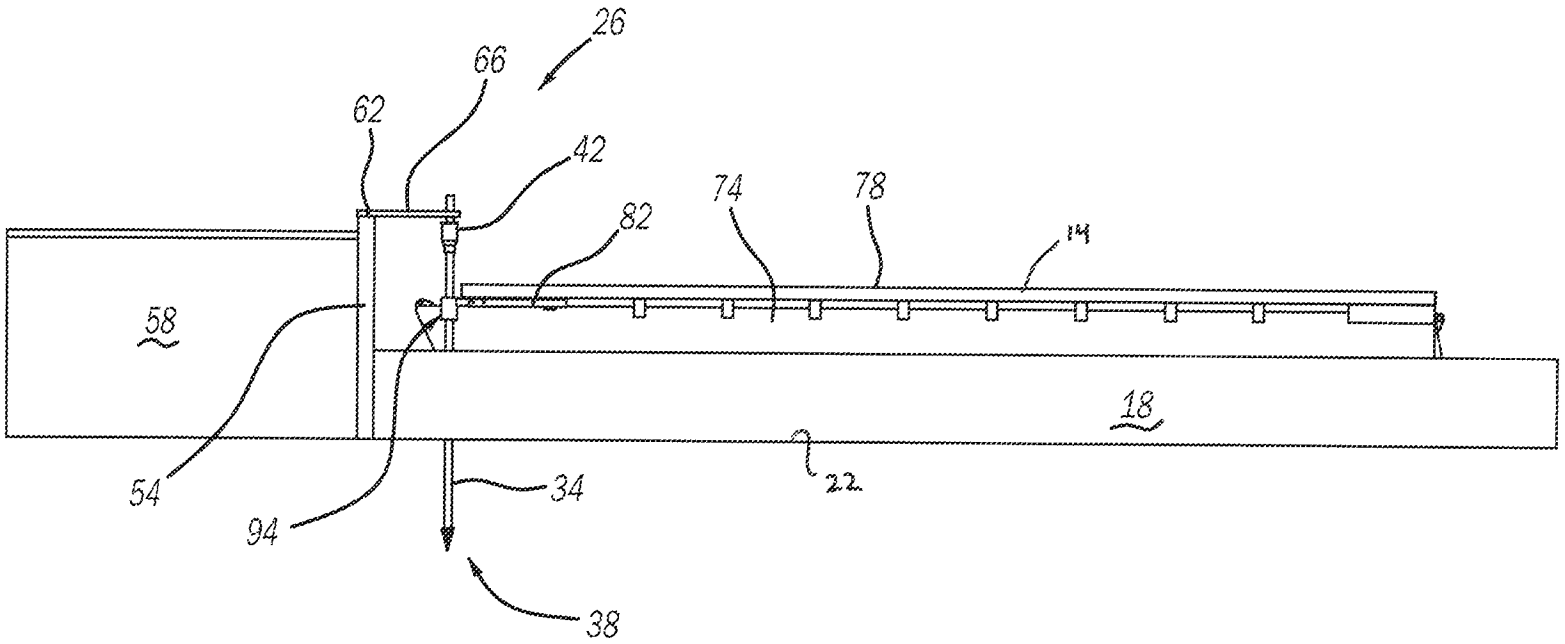
FIG. 7 is a schematic, side view of the docking system with the pontoon boat positioned so that the holders have the poles of the docking assemblies extending therethrough.

The boat 14 in the embodiment depicted is a pontoon boat having two pontoons 74 and a deck 78 mounted above the two pontoons 74. First and second receivers 82 are mounted to the underside 86 of the deck 78. FIG. 5 schematically depicts one of the receivers 82. Referring specifically to FIG. 5, in the embodiment depicted, each receiver 82 includes a cylindrical portion 200 with two flanges 204, 208 that cooperate to define a substantially planar surface 210. The cylindrical portion 200 defines a cylindrical space 202. The planar surface 210 is in contact with the deck 78 and fasteners (not shown) extend through the flanges 204, 208 to mount the receiver 82 to the deck 78. In one embodiment, the receiver 82 is a single piece of extruded aluminum.

The receivers 82 may be substantially as the one shown and described in United States Patent Publication No. 2022/0324539, published Oct. 13, 2022, and which is hereby incorporated by reference in its entirety.

First and second support members 90 are mounted with respect to the boat 14 via a respective one of the first and second receivers 82 and extend horizontally from the receivers to forward of the forward edge of the deck 78. More specifically, each of the members 90 extends into a respective cylindrical space 202 and is retained therein by fasteners (not shown).

Figure 8:
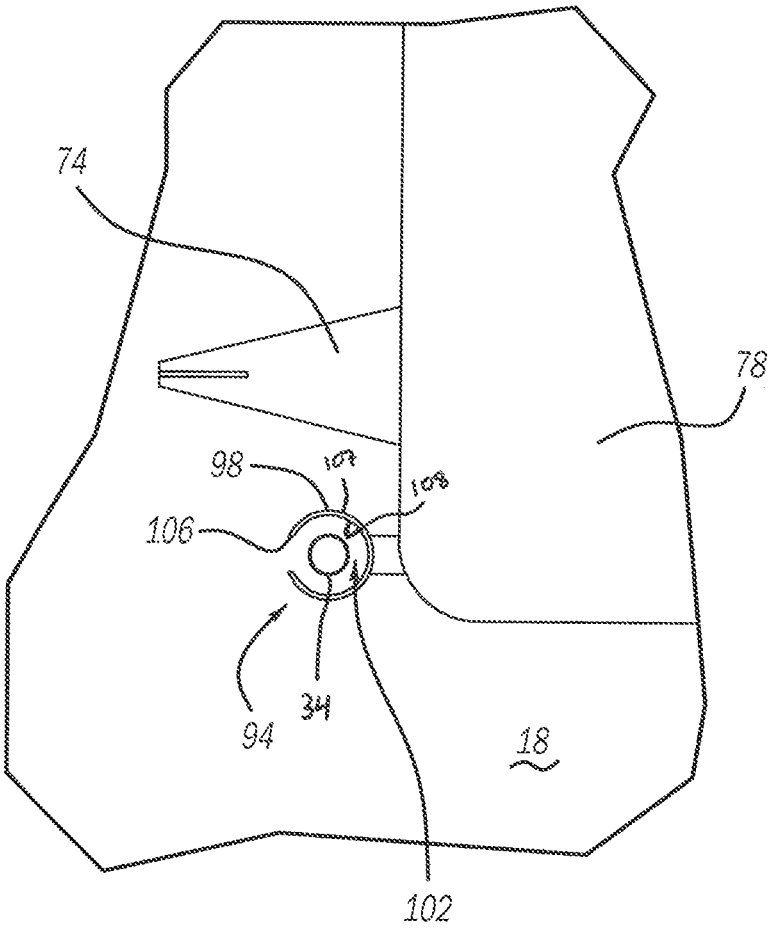
FIG. 8 is a schematic, sectional, top view of one of the holders with one of the poles extending therethrough.
Figure 9:
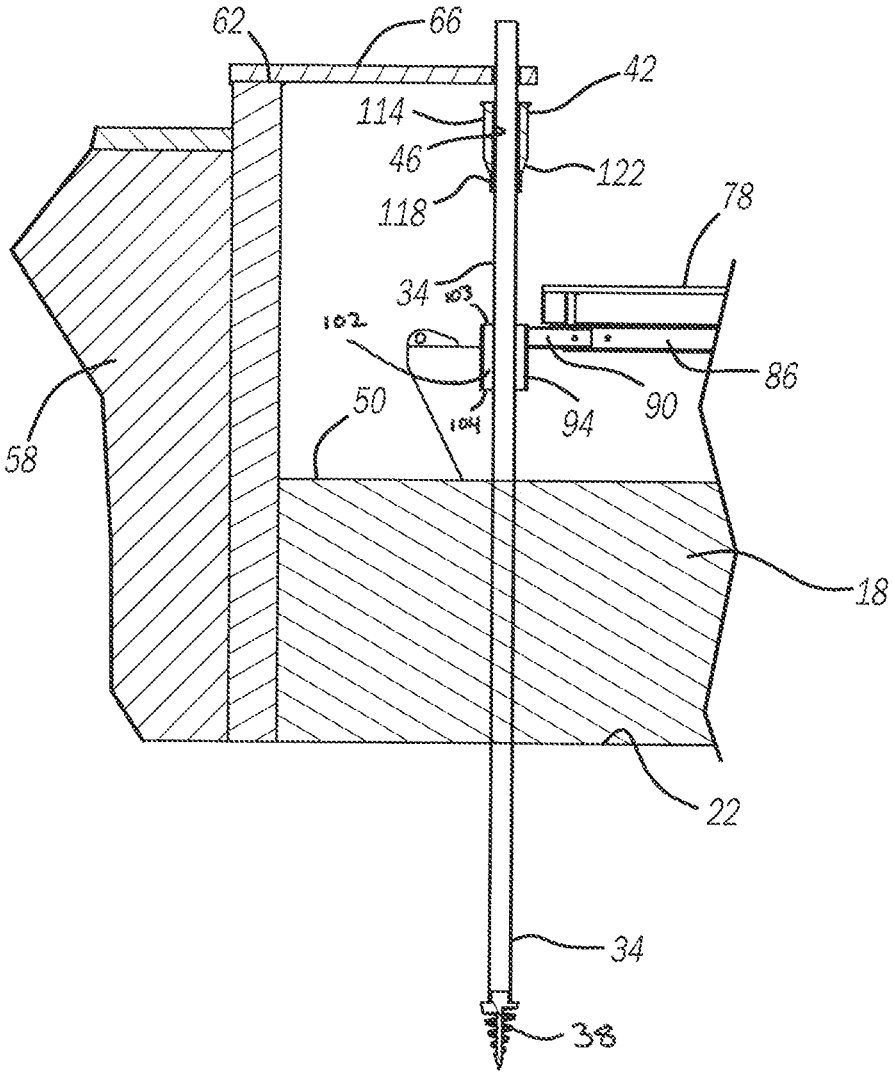
FIG. 9 is a schematic, sectional, side view of the docking system with the pontoon boat positioned so that the holders have the poles of the docking assemblies extending therethrough.
Figure 10:
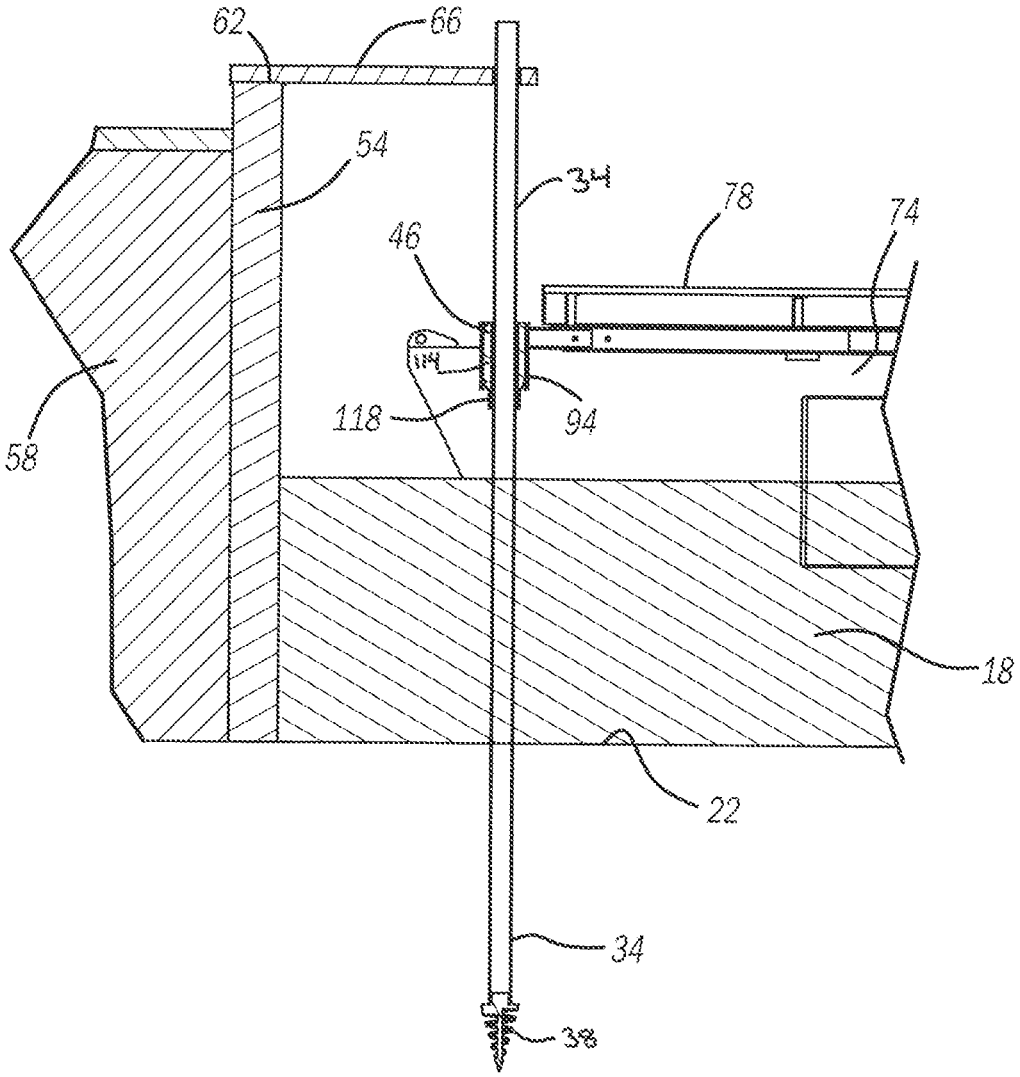
FIG. 10 is a schematic, sectional, side view of the pontoon boat positioned so that the holders have the poles extending therethrough and locking spacers have been lowered into the holders.

The system 10 includes two holder members 94, each being substantially identical to one another, and each being supported by a respective one of the support members 90 forward of the forward edge of the deck 78. Referring specifically to FIG. 8, each holder member 94 has a cylindrical wall 98 defining a cylindrical cavity 102 having an axis or centerline that extends vertically. The cavity 102 is upwardly and downwardly open, i.e., the holder member 94 defines an upper opening 103 and a lower opening 104 to the cylindrical cavity 102 at opposite ends of the member 94. The cylindrical wall 98 defines a forward slot 106 that extends from the upper opening 103 to the lower opening 104, and from the outer surface 107 of the wall 98 to the inner surface 108 of the wall 98. Thus, the slot 106 extends from the outer surface 107 to the cavity 102, and from the upper opening 103 to the lower opening 104.

The width of the slots 106, i.e., the horizontal dimension of the slots 106, is greater than the outer diameter of the poles 34, and thus each pole 34 is passable through a respective one of the slots 106 and into a respective one of the cavities 102 of a respective holder member 94. The outer surface 110 of each locking spacer 42 includes an upper segment 114, a lower segment 118, and a tapered segment 122. The upper segment 114 has a diameter that is slightly or marginally less than the diameter of the cavities 102. The lower segment 118 has a diameter that is less than the diameter of the upper segment 114, and the tapered segment 122 interconnects the upper and lower segments 114, 118 with a diameter that increases with height.

The upper segment 114 has approximately the same height as each of the cavities 102. The diameter of the upper segment 114 is greater than the width of the slots 106. Thus, while the locking spacers 42 are insertable into the cavities 102 via their upper or lower openings, the upper segment 118 of the locking spacer 42 cannot pass through the slots 106. Locking spacers 42 each include a top segment 126 having a diameter greater than the diameter of the cavity 102 so that the top segment 126 cannot be inserted into the cavity 102. Top segment 126 is positioned such that it contacts the top of the holder member 94 when segment 114 is within the cavity 102.

Figure 2:
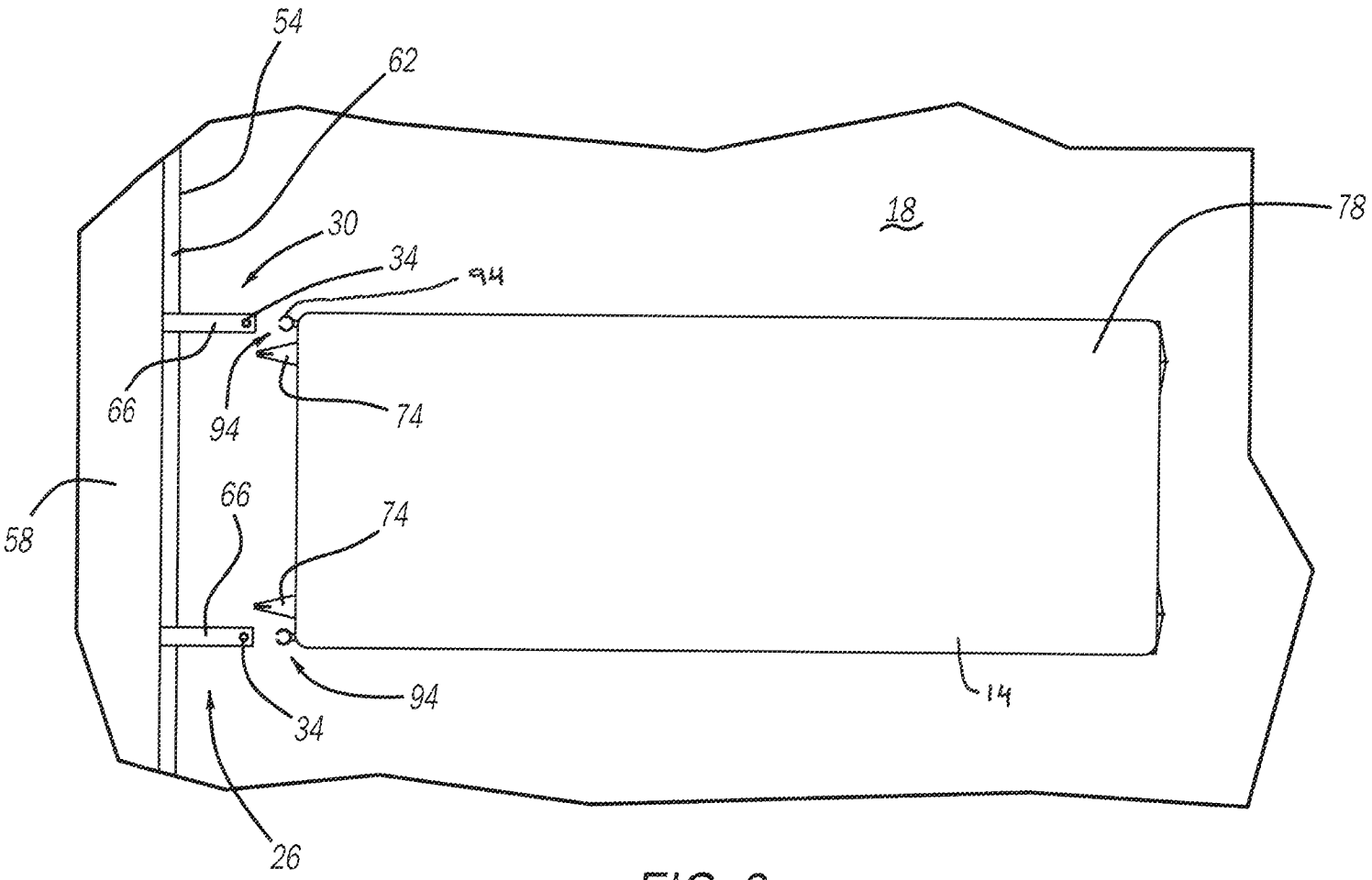
FIG. 2 is a schematic, top view of the docking system with the pontoon boat approaching the docking assemblies.
Figure 3:
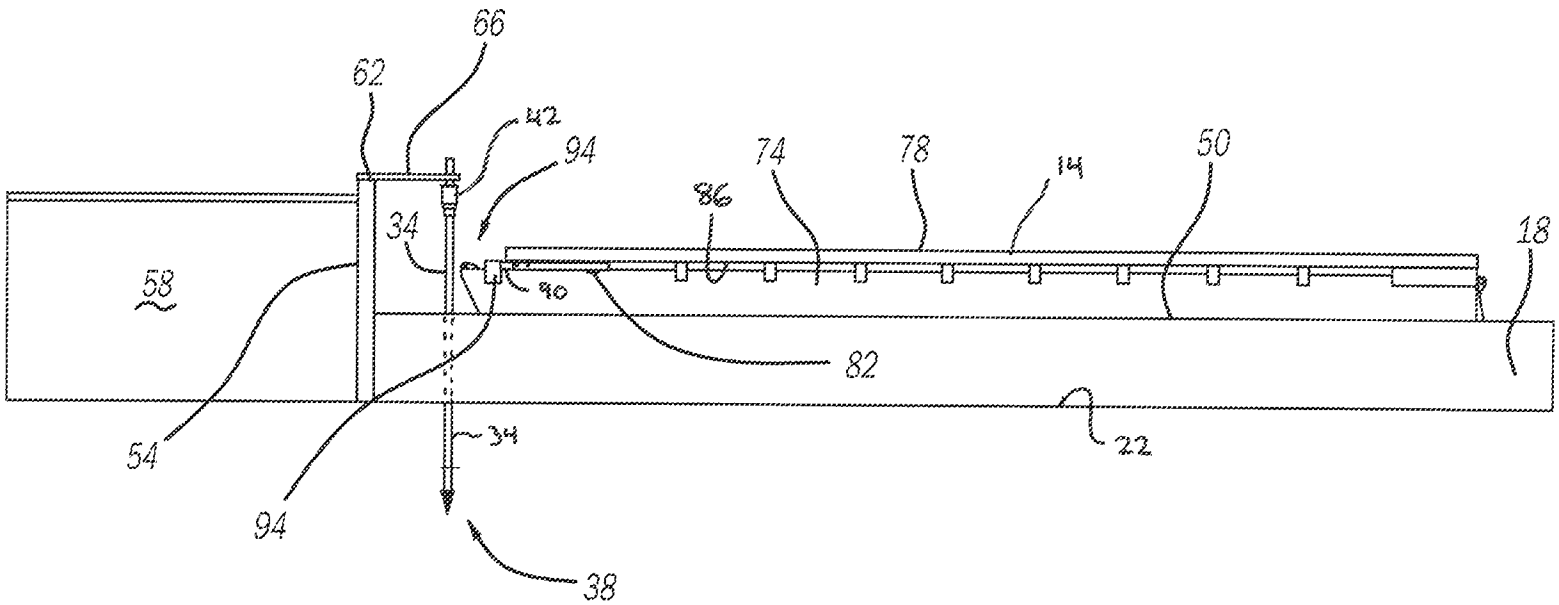
FIG. 3 is a schematic, side view of the docking system with the pontoon boat approaching the docking assemblies.
Figure 4:
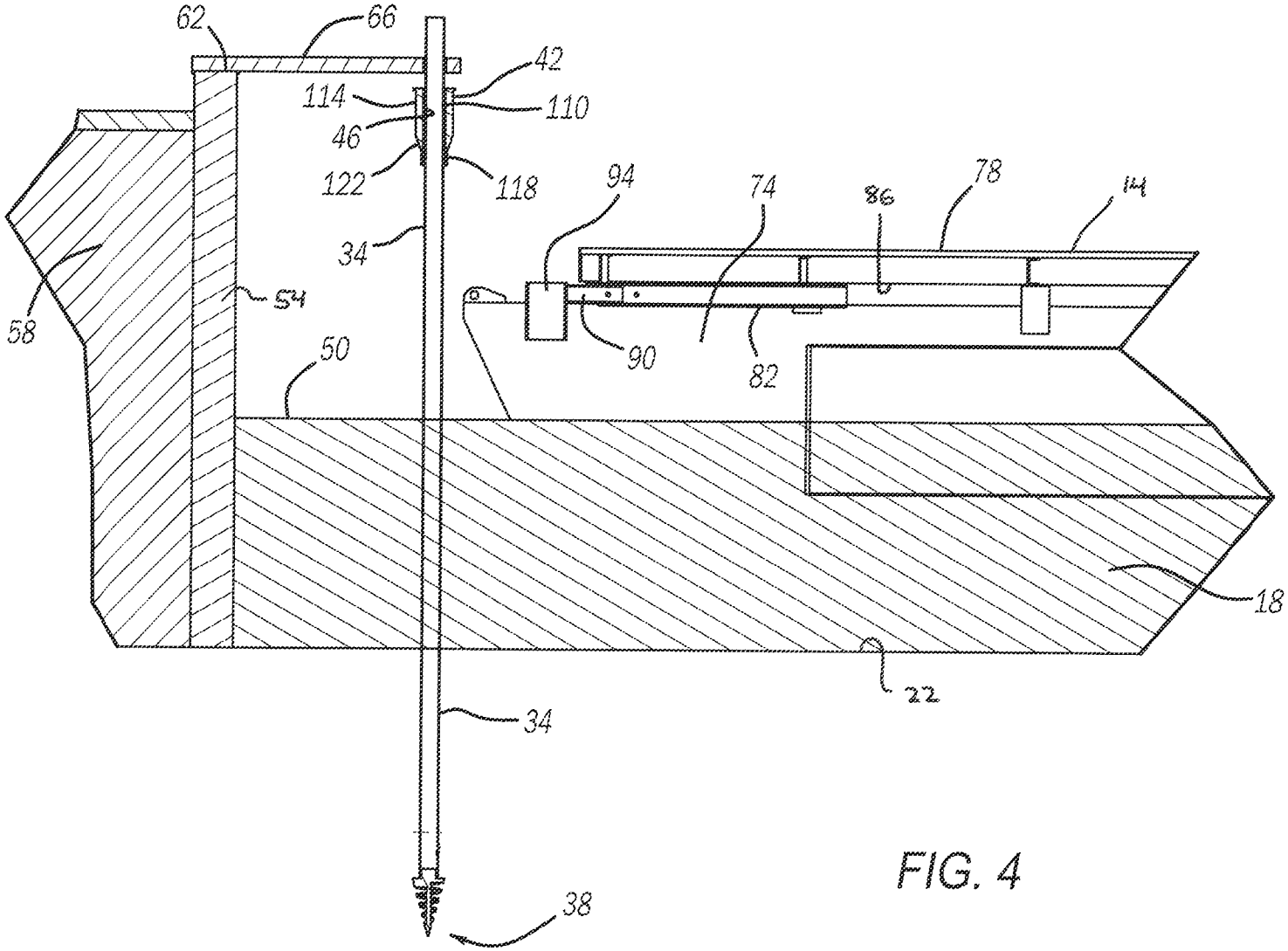
FIG. 4 is another schematic, side view of the docking system with the pontoon boat approaching the docking assemblies.

A method of using the system 10 includes operating the boat 14 such that forward slot 106 of each holder member 94 is aligned with a respective one of the poles 34 of a respective one of the docking assemblies 26, 30, as shown in FIGS. 2-4, and then maneuvering the boat 14 forward so that each pole 34 passes through a respective one of the slots 106 and then extends through a respective one of the cavities 102 defined by the holder members 94, as shown in FIGS. 6-9. The locking spacers 42 are positioned above the holder members 94 at this point. The method then includes lowering each locking spacer 42 such that each upper segment 114 is within a respective one of the cavities 102 of the holder members 94, thereby preventing movement of the boat 14 in a horizontal direction. To release the boat 14, the locking spacers 14 are raised out of the cavities 102.

Figure 11:
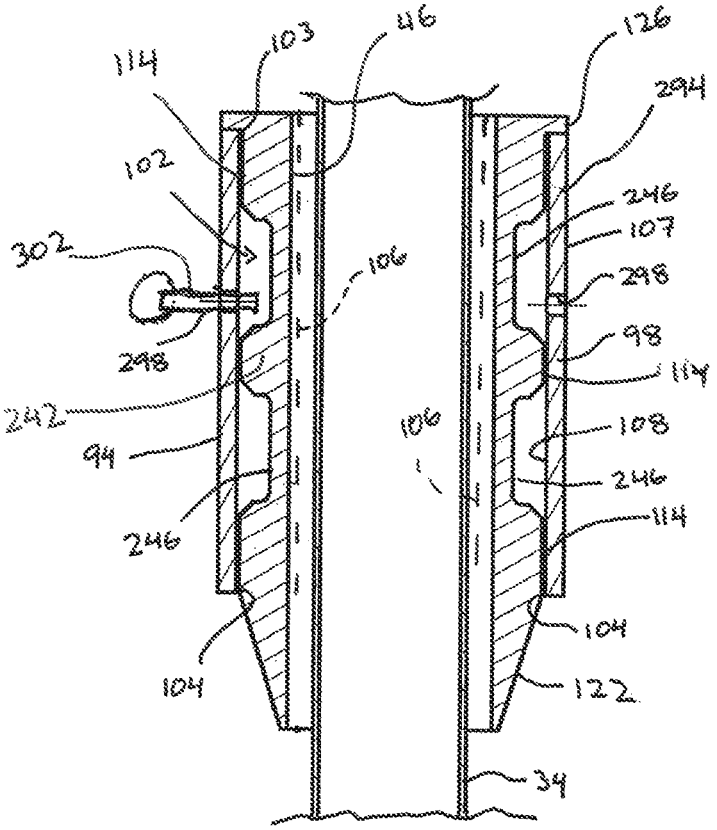
FIG. 11 is a schematic, cross-sectional, side view of an alternative holder member and locking spacer in accordance with the claimed invention.

FIG. 11 schematically depicts an alternative embodiment of a locking spacer 242 that may be used in place of locking spacers 42, and an alternative embodiment of a holder member 294 that may be used in place of holder members 94. Referring to FIG. 11, the holder member 294 is substantially identical to the holder member 94 except that wall 98 defines apertures 298 extending from the outer surface 107 to the inner surface 108.

The locking spacer 242 is substantially identical to the locking spacer 42, except that locking spacer 242 does not include segment 118, and segment 114 has annular grooves 246 formed therein to reduce weight. The pole 34 extends through the hole 46 of spacer 242 in the same manner that the pole 34 extends through the hole 46 of the locking spacer shown at 42 so that locking spacer 242 is slidable up and down along the pole 34.

The pole 34 is shown in FIG. 11 extending through the cavity 102 and openings 103, 104 after the pole 34 has passed through the slot 106. The locking spacer 242 is shown in FIG. 11 after the locking spacer 242 has been moved downward along the pole 34 to enter the cavity 102 through opening 103 so that segment 114 is within the cavity 102 and tapered segment 122 has exited the cavity 102 through opening 108.

The apertures 298 enable an optional detent pin 302 to be inserted through the wall 98 to selectively prevent the removal of the locking spacer 242 from the cavity 102. More specifically, the detent pin 302 extends through one of the apertures 298 and into one of the grooves 246 to prevent or limit up and down movement of the locking spacer 242 relative to the holder member 294 and the pole 34.

It should be noted that, although the holder members 94 are shown extending forward of the boat 14 in the embodiment depicted, the placement of the holder members 94 may include the sides and rear of the boat within the scope of the claimed invention. Furthermore, although the embodiment depicted includes two docking assemblies 26, 30 and two holder members 94, the system 10 may include one or more docking assemblies and one or more holder members within the scope of the claimed invention.

While the best modes for carrying out the invention have been described in detail, those familiar with the art to which this invention relates will recognize various alternative designs and embodiments for practicing the invention within the scope of the appended claims.

The invention claimed is:

1. A system for docking or mooring a floating object on a body of water having a bed, the system comprising:

a first docking assembly having a pole and a locking spacer, the pole being secured with respect to the bed of the body of water and extending at least partially above the body of water, the locking spacer defining a hole through which the pole extends such that the locking spacer is slidable along the pole;

a first member mounted to the floating object, said first member having a first end and a second end, an outer surface, and an inner surface defining a cavity having a first opening at the first end and a second opening at the second end, and a slot that extends from the outer surface to the inner surface and from the first opening to the second opening, said slot having a slot width;

wherein the first member is configured such that the pole is insertable into the cavity through the slot such that the pole extends through the first and second openings;

wherein the locking spacer is configured such that the locking spacer is insertable into the cavity through the first opening when the pole extends through the first and second openings; and wherein the locking spacer has a locking spacer width that is greater than the slot width.

2. The system of claim 1, wherein the pole is cylindrical and has a first diameter; and wherein the slot width is greater than the first diameter.

3. The system of claim 2, wherein the inner surface and the cavity are cylindrical;

wherein the cavity has a second diameter;

wherein the locking spacer has a first segment having a third diameter and a second segment adjacent to the first segment, said second segment being tapered; and wherein the third diameter is less than the second diameter and greater than the slot width.

4. The system of claim 1, wherein the first docking assembly includes an auger mounted to one end of the pole; and wherein the auger is within the bed of the body of water.

5. The system of claim 4, wherein the pole is substantially vertical.

6. The system of claim 1, wherein the floating object is a boat;

wherein the boat is a pontoon boat having two pontoons and a deck connected to the pontoons;

a receiver having a cylindrical portion with two flanges, the two flanges cooperating to define a substantially planar surface, the cylindrical portion defining a cylindrical space, the substantially planar surface being in contact with the deck;

a support being partially inserted into the cylindrical space and supporting the first member such that the boat is maneuverable so that the pole passes through the slot and into the cavity.

7. A system for docking or mooring a boat in a body of water having a bed, the system comprising:

a first docking assembly having a first pole; a first auger mounted at one end of the first pole, and a first locking spacer defining a first cylindrical hole therethrough; said first auger being within the bed; said first pole extending upward from the first auger to above the body of water; said first pole extending through said first cylindrical hole such that the first locking spacer is slidable along the first pole;

a second docking assembly having a second pole; a second auger mounted at one end of the second pole, and a second locking spacer defining a second cylindrical hole therethrough; said second auger being within the bed; said second pole extending upward from the second auger to above the body of water; said second pole extending through said second cylindrical hole such that the second locking spacer is slidable along the second pole;

a pontoon boat having two pontoons and a deck, said pontoons floating on the body of water;

first and second receivers mounted to the deck;

first and second support members, each of the first and second support members being mounted with respect to the boat via a respective one of the first and second receivers and extending horizontally from the first and second receivers to forward of a forward edge of the deck;

a first holder member being supported by the first support member forward of the forward edge of the deck, said first holder member having a first cylindrical wall defining a first cylindrical cavity having a first axis or centerline that extends vertically, said first holder member defining a first upper opening and a first lower opening to the first cylindrical cavity, said first cylindrical wall defining a first forward slot that extends from the first upper opening to the first lower opening; and a second holder being supported by the second support member forward of the forward edge of the deck, said second holder member having a second cylindrical wall defining a second cylindrical cavity having a second axis or centerline that extends vertically, said second holder member defining a second upper opening and a second lower opening to the second cylindrical cavity, said second cylindrical wall defining a second forward slot that extends from the second upper opening to the second lower opening;

wherein the boat is maneuverable such that the first and second poles enter the first and second cavities through the first and second forward slots, respectively, and the first and second locking spacers are slidable into the first and second cavities.

8. The system of claim 7, wherein the first pole has a first outer diameter;

wherein the second pole has a second outer diameter;

wherein the first forward slot has a first horizontal width;

wherein the second forward slot has a second horizontal width;

wherein the first horizontal width of the first forward slot is greater than the first outer diameter; and wherein the second horizontal width of the second forward slot is greater than the second outer diameter.

9. The system of claim 8, wherein the first cylindrical cavity has a third diameter;

wherein the second cylindrical cavity has a fourth diameter;

wherein the first locking spacer has a first portion having a fifth outer diameter that is less than the third diameter and greater than the first horizontal width of the first forward slot; and wherein the second locking spacer has a second portion having a sixth outer diameter that is less than the fourth diameter and greater than the second horizontal width of the second forward slot.

10. The system of claim 9, wherein the first and second locking spacers are tapered.

11. A method comprising:

maneuvering the boat of claim 9 such that the first forward slot is aligned with the first pole;

causing the boat to move such that the first pole passes through the first forward slot and extends through the first cylindrical cavity, the first upper opening, and the first lower opening;

with the first pole extending through the first cylindrical cavity, the first upper opening, and the first lower opening, sliding the first locking spacer downward along the first pole until the first portion is within the first cylindrical cavity;

maneuvering the boat of claim 9 such that the second slot is aligned with the second pole;

causing the boat to move such that the second pole passes through the second forward slot and extends through the second cylindrical cavity, the second upper opening, and the second lower opening; and with the second pole extending through the second cylindrical cavity, the second upper opening, and the second lower opening, sliding the second locking spacer downward along the second pole until the second portion is within the second cylindrical cavity.

* * * * *